US011231033B2

(12) United States Patent
Sugihara

(10) Patent No.: US 11,231,033 B2
(45) Date of Patent: Jan. 25, 2022

(54) CARTRIDGE VANE PUMP AND PUMP DEVICE

(71) Applicant: KYB Corporation, Tokyo (JP)

(72) Inventor: Masamichi Sugihara, Gifu (JP)

(73) Assignee: KYB CORPORATION, Tokyo (JP)

( * ) Notice: Subject to any disclaimer, the term of this patent is extended or adjusted under 35 U.S.C. 154(b) by 167 days.

(21) Appl. No.: 16/611,982

(22) PCT Filed: Apr. 25, 2018

(86) PCT No.: PCT/JP2018/016823
§ 371 (c)(1),
(2) Date: Nov. 8, 2019

(87) PCT Pub. No.: WO2018/207626
PCT Pub. Date: Nov. 15, 2018

(65) Prior Publication Data

US 2021/0095664 A1 Apr. 1, 2021

(30) Foreign Application Priority Data

May 10, 2017 (JP) ..... JP2017-094163

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/344*** | (2006.01) |

(Continued)

(52) U.S. Cl.
CPC ..... *F04C 2/3441* (2013.01); *F01C 21/106* (2013.01); *F04C 15/0023* (2013.01); *F04C 2240/20* (2013.01); *F04C 2240/805* (2013.01)

(58) Field of Classification Search
CPC ..... F04C 2/344; F04C 2/3441; F04C 2/3446; F04C 15/00; F04C 15/0023; F04C 2230/60; F04C 2240/20; F04C 2240/805; F01C 21/0836; F01C 21/10; F01C 21/104; F01C 21/106
See application file for complete search history.

(56) References Cited

U.S. PATENT DOCUMENTS 3,859,014 A * 1/1975 Dworak ..... F04C 15/0026 418/135
4,505,655 A * 3/1985 Honaga ..... F04C 15/0023 418/133

(Continued)

FOREIGN PATENT DOCUMENTS

JP 2001-003872 A 1/2001
JP 2006-518018 A 8/2006

(Continued)

*Primary Examiner* — Theresa Trieu
(74) *Attorney, Agent, or Firm* — Rabin & Berdo, P.C.

(57) ABSTRACT

A cartridge vane pump includes a rotor, a plurality of vanes, a cam ring, a side member brought into contact with a first end surface of the cam ring, a cover member brought into contact with a second end surface of the cam ring, the cover member being attached to the body, and a linkage member provided to extend between the side member and the cover member over an outer circumferential surface of the cam ring, the linkage member being configured to link the side member and the cover member.

3 Claims, 11 Drawing Sheets

(51) Int. Cl.
*F01C 21/10* (2006.01)
*F04C 15/00* (2006.01)

(56) References Cited

U.S. PATENT DOCUMENTS

| | | | | |
|---|---|---|---|---|
| 4,660,869 | A * | 4/1987 | Gabus | F16L 23/04 285/331 |
| 4,865,517 | A * | 9/1989 | Beehler | F04D 29/60 415/214.1 |
| 2006/0051230 | A1 | 3/2006 | Jordan | |
| 2015/0204326 | A1 | 7/2015 | Tsukahara et al. | |

FOREIGN PATENT DOCUMENTS

| | | | |
|---|---|---|---|
| JP | 2015-137567 | A | 7/2015 |
| WO | 2015082462 | A1 | 6/2015 |

* cited by examiner

CARTRIDGE VANE PUMP AND PUMP DEVICE

TECHNICAL FIELD

The present invention relates to a cartridge vane pump and a pump device including the cartridge vane pump.

BACKGROUND ART

JP2015-137567A discloses a vane pump provided with a rotor, a cam ring surrounding the rotor, and a first plate and a second plate that are provided such that the rotor and the cam ring are sandwiched therebetween. The first plate and the second plate are connected to each other by using connection rods that are respectively inserted into through holes in the cam ring. The rotor, the cam ring, the first plate, and the second plate form a single vane pump unit and are accommodated in a body on the side of a counterpart, such as a power steering apparatus, a transmission, and so force.

SUMMARY OF INVENTION

In the vane pump disclosed in JP2015-137567A, although stoppers are used to maintain the sandwiched state achieved with the connection rods, special tools and jigs are required to attach/remove the stoppers.

An object of the present invention is to easily achieve, without requiring special tools, a state in which a cartridge vane pump is sandwiched between a cover member and a side member, and a state in which the sandwiched state is released.

According to one aspect of the present invention, a cartridge vane pump attached to a body of a fluid pressure device includes: a rotor configured to be driven rotationally; a plurality of vanes provided in the rotor, the plurality of vanes being configured to reciprocate in a radial direction of the rotor; a cam ring having an inner circumference cam face with which the plurality of vanes are brought into sliding contact; a side member brought into contact with the rotor and a first end surface of the cam ring; a cover member brought into contact with the rotor and a second end surface of the cam ring, the cover member being attached to the body; and a linkage member provided to extend between the side member and the cover member over an outer circumferential surface of the cam ring, the linkage member being configured to link the side member and the cover member.

DESCRIPTION OF EMBODIMENTS

Embodiments of the present invention will be described below with reference to the drawings.

Cartridge vane pumps (hereinafter, simply referred to as "vane pump") 100, 200, and 300 according to first to third embodiments of the present invention are used as a fluid pressure source for a fluid pressure device mounted on a vehicle (for example, a power steering apparatus, a transmission, and so forth). Although descriptions are given to the vane pumps 100, 200, and 300 using working oil as working fluid in this description, aqueous alternative fluid such as working water, etc. may also be used as the working fluid.

In the description of each embodiment, although a surface of each member may be referred to as "an upper surface" or "a lower surface", the reference as above is made for the surface of each member only for the sake of ease of explanation, and there is no intention to limit an orientation and the attachment direction of the vane pumps 100, 200, and 300.

First Embodiment

A vane pump 100 according to a first embodiment of the present invention and a pump device 1000 provided with the vane pump 100 will be described first with reference to FIGS. 1 to 5.

Figure 1:
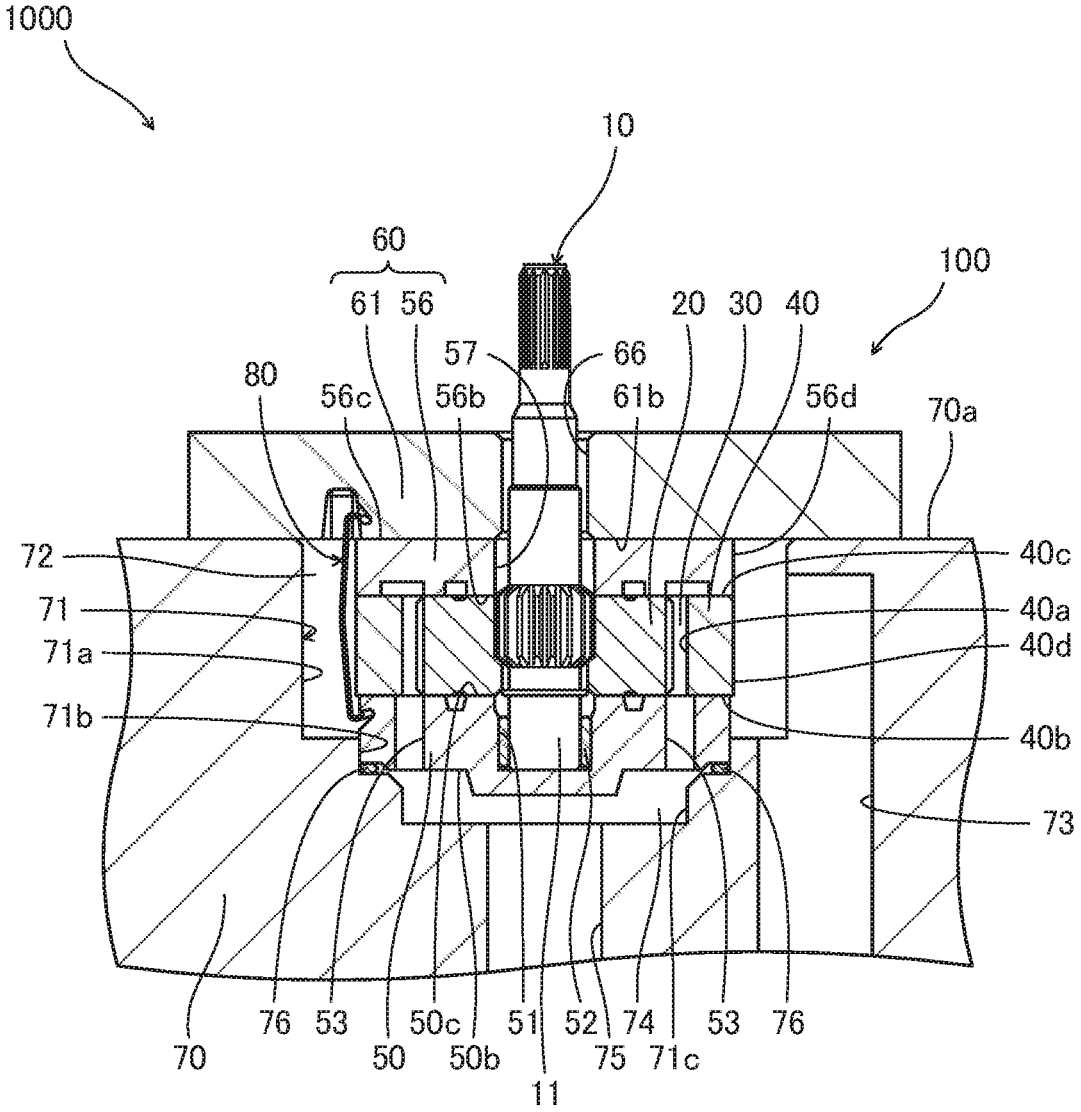
FIG. 1 is a sectional view of a pump device including a cartridge vane pump according to a first embodiment of the present invention.

As shown in FIG. 1, the vane pump 100 includes a driving shaft 10, a rotor 20 linked to the driving shaft 10, a plurality of vanes 30 provided in the rotor 20, and a cam ring 40 configured to accommodate the rotor 20 and the vanes 30. The rotor 20 is rotated together with the driving shaft 10 by a motive force transmitted from a driving source (for example, an engine, an electric motor, and so forth) to the driving shaft 10.

In the following description, the direction along the rotation center axis of the rotor 20 will be referred to as "the axial direction", the radiating direction centered at the rotation center axis of the rotor 20 will be referred to as "the radial direction", and the direction around the rotation center axis of the rotor 20 will be referred to as "the circumferential direction".

Figure 2:
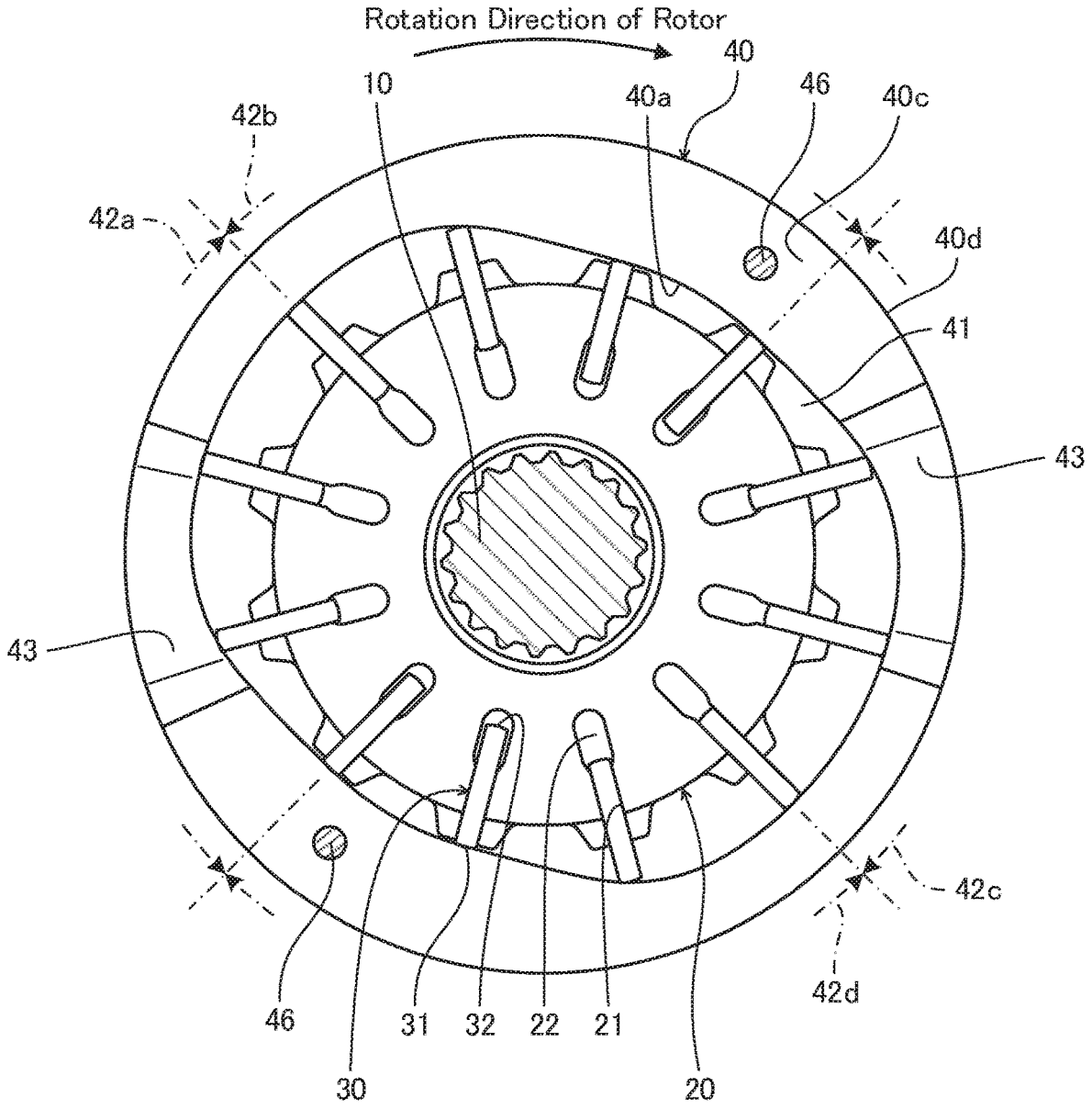
FIG. 2 is a plan view of a rotor, a vane, and a cam ring.

FIG. 2 is a plan view showing the rotor 20, the vanes 30, and the cam ring 40. As shown in FIG. 2, in the rotor 20, a plurality of slits 21 are formed in a radiating pattern with predetermined gaps therebetween. The slits 21 open at an outer circumferential surface of the rotor 20, and the vanes 30 are respectively inserted into the slits 21 so as to be freely reciprocatable in the radial direction.

Tip-end portions 31 of the vanes 30 face an inner circumferential surface 40*a* of the cam ring 40. Base-end portions 32 of the vanes 30 are positioned in the slits 21, and back pressure chambers 22 are formed by the slits 21 and the vanes 30.

As the rotor 20 is rotated, the vanes 30 are biased radially outward by a centrifugal force and projected out from the slits 21. As a result, the tip-end portions 31 of the vanes 30 are brought into sliding contact with the inner circumferential surface 40*a* of the cam ring 40, and thereby, pump chambers 41 are defined by the rotor 20, the adjacent vanes 30, and the cam ring 40.

The inner circumferential surface 40*a* of the cam ring 40 is formed to have a substantially oval shape. Thus, as the rotor 20 is rotated, the vanes 30 reciprocate in the radial direction with respect to the rotor 20. Along with the reciprocating movement of the vanes 30, the pump chambers 41 are repeatedly expanded and contracted. In the following description, the inner circumferential surface 40*a* of the cam ring 40 may also be referred to as "the inner circumference cam face 40*a*".

In the vane pump 100, as the rotor 20 completes a full rotation, the vanes 30 reciprocate twice, and the pump chambers 41 repeat the expansion and contraction twice. In other words, the vane pump 100 has, in an alternate manner in the circumferential direction, two expansion regions 42*a* and 42*c* where the pump chambers 41 are expanded and two contraction regions 42*b* and 42*d* where the pump chambers 41 are contracted.

As shown in FIG. 1, the vane pump 100 includes a body-side side plate (side member) 50 brought into contact with a first end surface 40*b* of the cam ring 40 and a cover-side side plate 56 brought into contact with a second end surface 40*c* of the cam ring 40. An upper surface 50*c* of the body-side side plate 50 faces one of end surfaces of the rotor 20, and a lower surface 56*b* of the cover-side side plate 56 faces the other of the end surfaces of the rotor 20.

The rotor 20 and the vanes 30 are brought into sliding contact with the upper surface 50*c* of the body-side side plate 50 and the lower surface 56*b* of the cover-side side plate 56. The pump chambers 41 (see FIG. 2) are sealed by the upper surface 50*c* of the body-side side plate 50 and the lower surface 56*b* of the cover-side side plate 56.

The body-side side plate 50 is formed with a shaft pit 51 opening at the upper surface 50*c*. The shaft pit 51 is formed coaxially with the rotation center axis of the rotor 20, and a one end portion 11 of the driving shaft 10 is inserted into the shaft pit 51.

A bearing 52 is provided between an outer circumferential surface of the one end portion 11 of the driving shaft 10 and an inner circumferential surface of the shaft pit 51. The driving shaft 10 is rotatably supported by the body-side side plate 50 via the bearing 52.

The cover-side side plate 56 is formed with a shaft hole 57 penetrating the cover-side side plate 56 in the axial direction. The shaft hole 57 is formed coaxially with the rotation center axis of the rotor 20, and the driving shaft 10 is inserted through the shaft hole 57.

Figure 3:
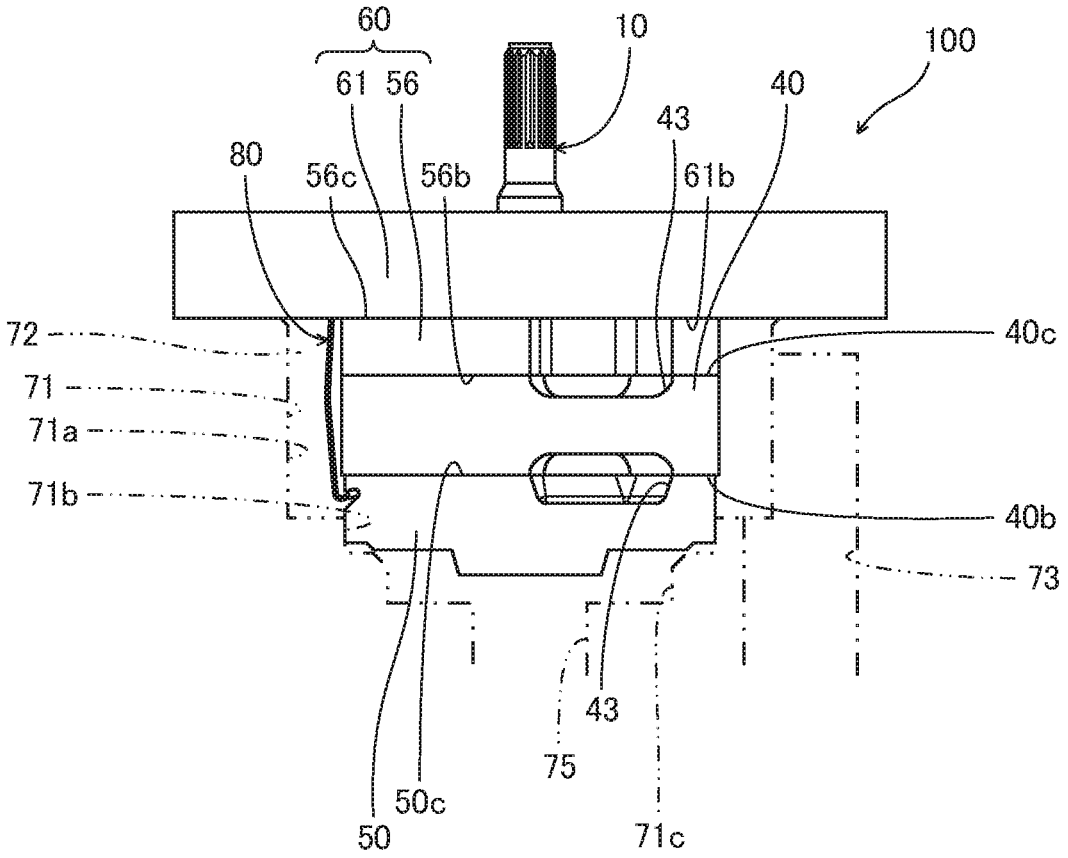
FIG. 3 is a front view of the cartridge vane pump shown in FIG. 1.

As shown in FIGS. 2 and 3, suction ports 43 are formed in the cam ring 40, the body-side side plate 50, and the cover-side side plate 56, and an external space of the vane pump 100 is communicated with the pump chambers 41 through the suction ports 43. The suction ports 43 are located in the expansion regions 42*a* and 42*c*. As the rotor 20 is rotated, the working oil outside the vane pump 100 is sucked into the pump chambers 41 through the suction ports 43.

As shown in FIG. 1, the body-side side plate 50 is formed with discharge ports 53 that penetrates in the axial direction and that allows the pump chambers 41 (see FIG. 2) to communicate with an outside space of the vane pump 100 through discharge ports 53. The discharge ports 53 are located in the contraction regions 42*b* and 42*d* (see FIG. 2).

As the rotor 20 is rotated, the working oil in the pump chambers 41 is discharged from the discharge ports 53 to the outside of the vane pump 100.

In addition, the vane pump 100 includes a cover 61 that is attached to a body 70 of the pump device 1000 by using bolts (not shown). By attaching the cover 61 to the body 70, the cam ring 40, the body-side side plate 50, and the cover-side side plate 56 are fixed to the body 70.

In the vane pump 100, the cover 61 is formed separately from the cover-side side plate 56, and a lower surface 61*b* of the cover 61 is brought into contact with an upper surface 56*c* of the cover-side side plate 56. A cover member 60 is formed by the cover 61 and the cover-side side plate 56.

The cover 61 is formed have a shaft hole 66 that penetrates in the axial direction. The shaft hole 66 is formed coaxially with the rotation center axis of the rotor 20, and the driving shaft 10 is inserted into the shaft hole 66. The driving shaft 10 is rotatably supported by the cover 61 via a bearing (not shown).

The lower surface 61*b* of the cover 61 is formed with pin holes (not shown) into which dowel pins 46 (see FIG. 2) are press-fitted. The dowel pins 46 are inserted into pin holes in the cover-side side plate 56 and the cam ring 40 and into pin holes in the body-side side plate 50. With the dowel pins 46, the cover 61, the cover-side side plate 56, and the body-side side plate 50 are aligned with respect to the cam ring 40.

The cam ring 40, the body-side side plate 50, and the cover-side side plate 56 of the vane pump 100 are accommodated in an accommodating concave portion 71 formed in the body 70. The accommodating concave portion 71 is formed by a first concave portion 71*a* that opens at an upper surface 70*a* of the body 70, a second concave portion 71*b* that opens at a bottom surface of the first concave portion 71*a*, and a third concave portion 71*c* that opens at a bottom surface of the second concave portion 71*b*.

The opening of the first concave portion 71*a* is closed by the lower surface 61*b* of the cover 61. An inner circumferential surface of the first concave portion 71*a* faces an outer circumferential surface 40*d* of the cam ring 40 and an outer circumferential surface 56*d* of the cover-side side plate 56 such that a gap is formed therebetween. An annular low pressure chamber 72 that forms a part of a suction passage 73 is formed by the first concave portion 71*a*, the cam ring 40, and the cover-side side plate 56.

The low pressure chamber 72 communicates with the pump chambers 41 via the suction ports 43 (see FIG. 3) and with a tank (not shown) via the suction passage 73 formed in the body 70. When the vane pump 100 is operated, the working oil in the tank is sucked into the pump chambers 41 via the suction passage 73, the low pressure chamber 72, and the suction ports 43.

A bottom surface of the third concave portion 71*c* faces a lower surface 50*b* of the body-side side plate 50 such that a gap is formed therebetween. A high-pressure chamber 74 is formed by the third concave portion 71*c* and the body-side side plate 50.

The high-pressure chamber 74 communicates with the pump chambers 41 via the discharge ports 53 and with a discharge passage 75 formed in the body 70. When the vane pump 100 is operated, the working oil in the pump chambers 41 is discharged to the discharge passage 75 via the discharge ports 53 and the high-pressure chamber 74.

The high-pressure chamber 74 also communicates with the back pressure chambers 22 (see FIG. 2), and thereby, the working oil in the high-pressure chamber 74 is guided to the back pressure chambers 22. Therefore, the vanes 30 are biased radially outward not only by the centrifugal force, but also by the pressure in the back pressure chambers 22.

A part of the body-side side plate 50 is fitted into an inner circumferential surface of the second concave portion 71*b*. An annular seal member 76 is provided between the lower surface 50*b* of the body-side side plate 50 and the bottom surface of the second concave portion 71*b*. A gap between the lower surface 50*b* of the body-side side plate 50 and the bottom surface of the second concave portion 71*b* is closed by the seal member 76. By providing the seal member 76, it is possible to prevent the working oil from flowing back and forth between the low pressure chamber 72 and the high-pressure chamber 74 through the gap.

In a state in which the cover 61 is attached to the body 70, the seal member 76 is compressed by the body-side side plate 50 and the body 70 and biases the body-side side plate 50, the cam ring 40, and the cover-side side plate 56 towards the cover 61. Thus, leakage of the working oil in the pump chambers 41 (see FIG. 2) from between the cam ring 40 and the body-side side plate 50 and from between the cam ring 40 and the cover-side side plate 56 tends not to be caused. Therefore, it is possible to improve the discharge performance of the vane pump 100.

The vane pump 100 further includes a flat spring (linkage member) 80 that links the body-side side plate 50 and the cover 61. With the flat spring 80, movement of the body-side side plate 50 in the direction away from the cover 61 is restricted. In other words, even in a case in which only the cover 61 is lifted up in a state in which the cover 61 is not attached to the body 70, the body-side side plate 50 is not separated away from the cover 61. Therefore, it is possible to transport the cover 61 and the body-side side plate 50 while preventing disengagement thereof due to vibrations, etc. during the transport.

As described above, the rotor 20, the vanes 30, the cam ring 40, and the cover-side side plate 56 are positioned between the body-side side plate 50 and the cover 61. Thus, in a state in which the body-side side plate 50 and the cover 61 are linked by the flat spring 80, the rotor 20, the vanes 30, the cam ring 40, and the cover-side side plate 56 are held between the cover 61 and the body-side side plate 50.

Similarly to the body-side side plate 50, even in a case in which only the cover 61 is lifted up in a state in which the cover 61 is not attached to the body 70, the rotor 20, the vanes 30, the cam ring 40, and the cover-side side plate 56 are not separated away from the cover 61. Therefore, it is possible to transport the vane pump 100 while preventing disengagement thereof due to vibrations, etc. during the transport, and so, it is possible to attach the vane pump 100 to the body 70. Thus, it is possible to improve the ease of attachment of the vane pump 100.

In addition, in detaching the vane pump 100 from the body 70, the rotor 20, the vanes 30, the cam ring 40, the body-side side plate 50, and the cover-side side plate 56 are moved out from the accommodating concave portion 71 only by separating the cover 61 from the body 70. Therefore, it is possible to detach the vane pump 100 from the body 70 with ease.

The flat spring 80 is provided to extend between the cover 61 and the body-side side plate 50 over the outer circumferential surface 40*d* of the cam ring 40 and the outer circumferential surface 56*d* of the cover-side side plate 56. Thus, there is no need to form a hole for inserting the flat spring 80 in the cam ring 40 and the cover-side side plate 56. Therefore, because it is not necessary to process the cam ring 40 and the cover-side side plate 56 for linking the cover 61 and the body-side side plate 50, it is possible to form the vane pump 100 with ease.

Figure 4:
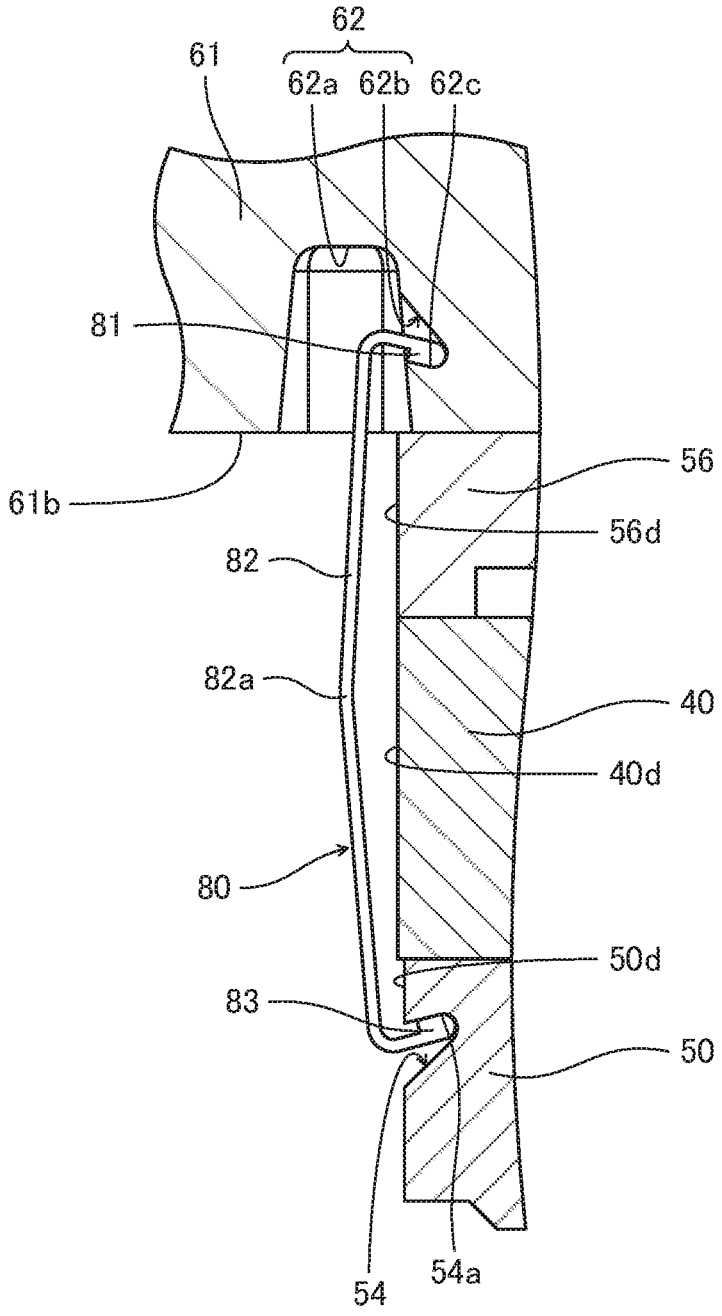
FIG. 4 is an enlarged sectional view of the cartridge vane pump shown in FIG. 1 and shows a vicinity of a flat spring.

FIG. 4 is an enlarged sectional view of the vane pump 100 and shows a vicinity of the flat spring 80. As shown in FIG. 4, the flat spring 80 has a linkage portion 81 linked to the cover 61, an extended portion 82 extending along the axial direction, and a support portion 83 supporting the body-side side plate 50.

The extended portion 82 is formed with a substantially plate shape and faces the outer circumferential surface 40*d* of the cam ring 40 and the outer circumferential surface 56*d* of the cover-side side plate 56. The linkage portion 81 projects radially inward from one end portion of the extended portion 82. In other words, the extended portion 82 extends in the axial direction from the linkage portion 81 towards the body-side side plate 50.

The linkage portion 81 is inserted into a hole portion 62 formed in the cover 61. The hole portion 62 is formed of a longitudinal hole 62*a* that opens at the lower surface 61*b* of the cover 61 and a lateral hole 62*b* that opens at an inner circumferential surface of the longitudinal hole 62*a*. The opening of the longitudinal hole 62*a* is located radially outward of a region of the lower surface 61*b* of the cover 61 where the cover-side side plate 56 is brought into contact therewith, and the opening is not closed by the cover-side side plate 56.

The lateral hole 62*b* is formed to extend from the center axis of the longitudinal hole 62*a* towards the center axis of the rotor 20. The linkage portion 81 of the flat spring 80 is inserted into the lateral hole 62*b* by inserting the linkage portion 81 and the one end portion of the extended portion 82 into the longitudinal hole 62*a*, and thereafter, by moving them radially inward.

In a state in which the linkage portion 81 is inserted in the lateral hole 62*b*, the linkage portion 81 is placed on an inner circumferential surface 62*c* of the lateral hole 62*b* and is supported by the cover 61. As described above, the linkage portion 81 is linked to the cover 61 by being inserted into the lateral hole 62*b*.

A tip end of the linkage portion 81 has a rounded shape. Thus, in inserting the linkage portion 81 into the lateral hole 62*b*, the tip end of the linkage portion 81 is less likely to be caught on an opening edge of the lateral hole 62*b*. Therefore, it is possible to insert the linkage portion 81 into the lateral hole 62*b* with ease.

The support portion 83 of the flat spring 80 projects radially inward from other end portion of the extended portion 82 and is inserted into a groove (recessed portion) 54 formed in an outer circumferential surface 50*d* of the body-side side plate 50. The groove 54 extends in the circumferential direction such that a side surface 54*a* of the groove 54 intersects the axial direction. In a state in which the support portion 83 is inserted in the groove 54, the side surface 54*a* of the groove 54 faces the support portion 83 in the axial direction. With such a configuration, the body-side side plate 50 is supported by the support portion 83.

Similarly to the linkage portion 81, a tip end of the support portion 83 has a rounded shape. Thus, in inserting the support portion 83 into the groove 54, the tip end of the support portion 83 is less likely to be caught on an opening edge of the groove 54. Therefore, it is possible to insert the support portion 83 into the groove 54 with ease.

Figure 5:
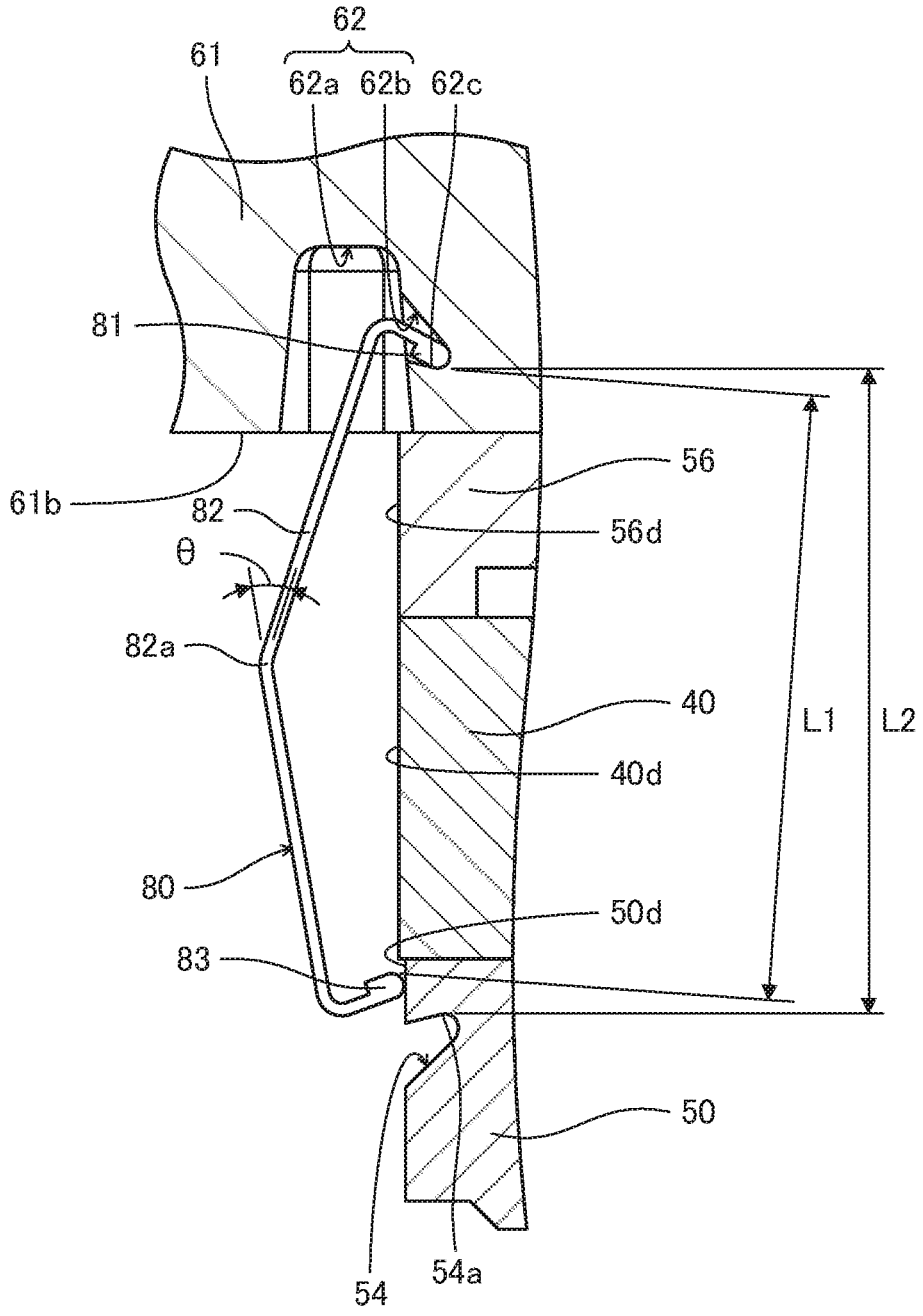
FIG. 5 is an enlarged sectional view of the cartridge vane pump shown in FIG. 1 and shows a state in which a linkage achieved by the flat spring is released in a manner corresponding to FIG. 4.

FIG. 5 is a sectional view showing a state in which a linkage between the cover 61 and the body-side side plate 50 by the flat spring 80 is released. In the state shown in FIG. 5, no external force is applied to the flat spring 80.

As shown in FIG. 5, the extended portion 82 is formed with a bent portion 82*a* between the linkage portion 81 and the support portion 83 so as to project towards the opposite side from the support portion 83. The bent portion 82*a* is formed so as to deform when the external force is applied to the flat spring 80 and so as to return to its original shape when the external force is removed.

A distance L1 between the linkage portion 81 and the support portion 83 is changed correspondingly to the deformation of the bent portion 82*a*. More specifically, when the bent portion 82*a* is deformed in the direction in which the bent angle θ of the bent portion 82*a* is reduced, the support portion 83 moves away from the linkage portion 81, and the distance L1 is increased. When the bent portion 82*a* is deformed in the direction in which the bent angle θ of the bent portion 82*a* is increased, the support portion 83 moves towards the linkage portion 81, and the distance L1 is shortened.

In a state in which the external force is not applied to the flat spring 80 (in a state shown in FIG. 5), the distance L1 is shorter than a distance L2 between the lateral hole 62*b* of the cover 61 and the groove 54 of the body-side side plate 50. Thus, in a state in which the cover 61 and the body-side side plate 50 are linked by the flat spring 80 (in a state shown in FIG. 4), the flat spring 80 exhibits the resilience and biases the body-side side plate 50 towards the cover 61.

As described above, the cam ring 40 and the cover-side side plate 56 are positioned between the body-side side plate 50 and the cover 61. Thus, the flat spring 80 biases, with its resilience, the body-side side plate 50, the cam ring 40, and the cover-side side plate 56 towards the cover 61. Therefore, it is possible to prevent leakage of the working oil in the pump chambers 41 (see FIG. 2) from between the cam ring 40 and the body-side side plate 50 and from between the cam ring 40 and the cover-side side plate 56, and so, it is possible to improve the discharge performance of the vane pump 100.

The support portion 83 projects radially inward from the extended portion 82. Thus, the body-side side plate 50 is supported in the axial direction by the support portion 83 only by inserting the support portion 83 into the groove 54 of the body-side side plate 50 and by placing the body-side side plate 50 on the support portion 83. Therefore, in linking the body-side side plate 50 to the cover 61, special jigs need not be used to fix the support portion 83 to the body-side side plate 50, and so, it is possible to assemble the vane pump 100 with ease.

The bent portion 82*a* of the flat spring 80 is bent so as to project towards the opposite side from the support portion 83. Thus, the bent portion 82*a* is expanded and extended only by pushing the bent portion 82*a* towards the cam ring 40 in a state in which the linkage portion 81 is linked to the cover 61 and the support portion 83 is brought into contact with the outer circumferential surface 50*d* of the body-side side plate 50. As a result, the distance L1 between the support portion 83 and the linkage portion 81 is increased, and thus, the support portion 83 reaches the groove 54 of the body-side side plate 50 and is inserted into the groove 54.

As described above, in the vane pump 100, it is possible to allow the body-side side plate 50 to be supported by the support portion 83 only by pushing the bent portion 82*a* towards the cam ring 40 in a state in which the linkage portion 81 is linked to the cover 61. Therefore, it is possible to link the body-side side plate 50 and the cover 61 with ease, and so, the assemblability of the vane pump 100 is improved.

In addition, the groove 54 opens at the outer circumferential surface 50*d* of the body-side side plate 50. Thus, the support portion 83 is moved out from the groove 54 only by pulling and separating the extended portion 82 from the cam ring 40 in a state in which the support portion 83 is inserted in the groove 54. Therefore, the linkage between the body-side side plate 50 and the cover 61 by the flat spring 80 can be released with ease, and therefore, it is possible to easily disassemble the vane pump 100.

The inner circumferential surface 62*c* of the lateral hole 62*b* of the cover 61 is inclined with respect to the radial direction so as to approach the groove 54 of the body-side side plate 50 when going toward the inside in the radial direction. Thus, in a state in which the body-side side plate 50 is biased towards the cover 61 by the flat spring 80, the linkage portion 81 of the flat spring 80 is not moved out easily from the lateral hole 62*b*. Therefore, it is possible to prevent the flat spring 80 from being dismounted from the cover 61, and so, it is possible to prevent unintentional disassembly of the vane pump 100.

The side surface 54*a* of the groove 54 of the body-side side plate 50 is inclined with respect to the radial direction so as to approach the lateral hole 62*b* of the cover 61 when going toward the inside in the radial direction. Thus, in a state in which the body-side side plate 50 is biased towards the cover 61 by the flat spring 80, the support portion 83 of the flat spring 80 is not moved out easily from the groove 54. Therefore, it is possible to prevent the flat spring 80 from being dismounted from the body-side side plate 50, and so, it is possible to prevent unintentional disassembly of the vane pump 100.

As shown in FIG. 1, the flat spring 80 is accommodated in the low pressure chamber 72. Thus, a space for accommodating the flat spring 80 need not be formed separately from the low pressure chamber 72 in the body 70. Therefore, it is possible to reduce the size of the body 70, and hence, it is possible to reduce the size of the pump device 1000.

Because the body-side side plate 50 is biased towards the cover 61 by the flat spring 80, even if a force is applied by the working oil flowing through the low pressure chamber 72, the flat spring 80 is not taken off from the body-side side plate 50 and the cover 61. Therefore, the linkage between the body-side side plate 50 and the cover 61 by the flat spring 80 is not released, and so, it is possible to detach the vane pump 100 from the body 70 with ease.

Next, a description will be given to a method of assembling the vane pump 100.

The dowel pins 46 are first press-fitted into the pin holes (not shown) of the cover 61. Thereafter, the cover-side side plate 56 and the cam ring 40 are stacked on the cover 61 in this order. At this time, the dowel pins 46 are inserted into the pin holes of the cover-side side plate 56 and the cam ring 40.

Next, the rotor 20 is allowed to be accommodated in an inner circumference of the cam ring 40, and the driving shaft 10 is inserted into a spline hole of the rotor 20, the shaft hole 57 of the cover-side side plate 56, and the shaft hole 66 of the cover 61. The vanes 30 are accommodated in the slits 21 of the rotor 20, and the tip-end portions 31 of the vanes 30 face the inner circumference cam face 40*a* of the cam ring 40.

Next, the body-side side plate 50 is stacked on the cam ring 40. At this time, the dowel pins 46 are inserted into the pin holes of the body-side side plate 50, and the driving shaft 10 is inserted into the shaft pit 51 of the body-side side plate 50.

Next, the linkage portion 81 of the flat spring 80 is inserted into the longitudinal hole 62*a* and the lateral hole 62*b* of the cover 61. By doing so, the linkage portion 81 is linked to the cover 61. At this time, the external force is not applied to the bent portion 82*a* of the flat spring 80, and the distance L1 between the support portion 83 and the linkage portion 81 is shorter than the distance L2 between the lateral hole 62*b* and the groove 54 of the body-side side plate 50.

Next, the bent portion 82*a* of the flat spring 80 is pushed towards the cam ring 40. As a result, the support portion 83 slides on the outer circumferential surface 50*d* of the body-side side plate 50, and the bent portion 82*a* is expanded and extended. The distance L1 between the support portion 83 and the linkage portion 81 is thus increased, and the support portion 83 reaches the groove 54 of the body-side side plate 50 and is inserted into the groove 54. As a result, the linkage between the cover 61 and the body-side side plate 50 is achieved, and the assembly of the vane pump 100 is completed.

In a state in which the cover 61 is linked to the body-side side plate 50 by the flat spring 80, movement of the body-side side plate 50 in the direction away from the cover 61 is restricted. Thus, even if only the cover 61 is lifted up in a state in which the lower surface 61*b* of the cover 61 is facing downwards, the cover-side side plate 56, the rotor 20, the vanes 30, the cam ring 40, and the body-side side plate 50 are not separated away from the cover 61. Therefore, it is possible to transport the vane pump 100 while preventing disengagement thereof due to vibrations, etc. during the transport, and so, it is possible to attach the vane pump 100 to the body 70. Thus, it is possible to improve the ease of attachment of the vane pump 100.

According to the above-mentioned first embodiment, the advantages described below are afforded.

In the vane pump 100, because the body-side side plate 50 is linked to the cover 61 by the flat spring 80, the rotor 20, the vanes 30, the cam ring 40, and the cover-side side plate 56 are held between the cover 61 and the body-side side plate 50. Therefore, it is possible to transport the vane pump 100 while preventing disengagement thereof due to vibrations, etc. during the transport, and so, it is possible to attach the vane pump 100 to the body 70 of the pump device 1000. Thus, it is possible to improve the assemblability of the vane pump 100.

In the vane pump 100, the flat spring 80 is provided to extend between the cover 61 and the body-side side plate 50 over the outer circumferential surface 40*d* of the cam ring 40 and the outer circumferential surface 56*d* of the cover-side side plate 56. Thus, there is no need to form a hole for inserting the flat spring 80 in the cam ring 40 and the cover-side side plate 56. Therefore, because it is not necessary to process the cam ring 40 and the cover-side side plate 56 for linking the cover 61 and the body-side side plate 50, it is possible to form the vane pump 100 with ease.

In addition, in the vane pump 100, the body-side side plate 50, the cam ring 40, and the cover-side side plate 56 are biased towards the cover 61 by the flat spring 80. Thus, the leakage of the working oil in the pump chambers 41 from between the cam ring 40 and the body-side side plate 50, and from between the cam ring 40 and the cover-side side plate 56 tends not to be caused. Therefore, it is possible to improve the discharge performance of the vane pump 100.

In addition, in the vane pump 100, the extended portion 82 of the flat spring 80 extends in the axial direction of the rotor 20, and the support portion 83 of the flat spring 80 projects radially inward from the extended portion 82. It is only required to place the body-side side plate 50 on the support portion 83 in order to support the body-side side plate 50 with the support portion 83 in the axial direction of the rotor 20, and there is no need to use the special jigs. Therefore, it is possible to link the body-side side plate 50 to the cover 61 with ease, and so, it is possible to assemble the vane pump 100 with ease.

In addition, in the vane pump 100, the bent portion 82*a* of the flat spring 80 is bent so as to project towards the opposite side from the support portion 83. Thus, the support portion 83 slides on the outer circumferential surface 50*d* of the body-side side plate 50 and is inserted into the groove 54 of the body-side side plate 50 only by pushing the bent portion 82*a* towards the cam ring 40 in a state in which the linkage portion 81 is linked to the cover 61. Therefore, it is possible to link the body-side side plate 50 to the cover 61 with ease, and so, the assemblability of the vane pump 100 is improved.

In addition, in the vane pump 100, the groove 54 opens at the outer circumferential surface 50*d* of the body-side side plate 50. Thus, the support portion 83 is moved out from the groove 54 only by pulling and separating the extended portion 82 from the cam ring 40 in a state in which the support portion 83 is inserted in the groove 54. Therefore, the linkage between the body-side side plate 50 and the cover 61 by the flat spring 80 can be released with ease, and therefore, it is possible to easily disassemble the vane pump 100.

In addition, in the pump device 1000, because the flat spring 80 is accommodated in the low pressure chamber 72 that is formed between the body 70 and the cam ring 40, a separate space for accommodating the flat spring 80 need not be formed in the body 70. Therefore, it is possible to reduce the size of the body 70, and hence, it is possible to reduce the size of the pump device 1000.

Second Embodiment

Next, a vane pump 200 according to a second embodiment of the present invention will be described with reference to FIGS. 6 to 9. Configurations that are the same as those in the vane pump 100 are assigned the same reference numerals and description thereof shall be omitted. In addition, a sectional view of the pump device provided with the vane pump 200 is substantially the same as the sectional view of the vane pump 100 (see FIG. 1), and so, illustration thereof is omitted in this section.

Figure 6:
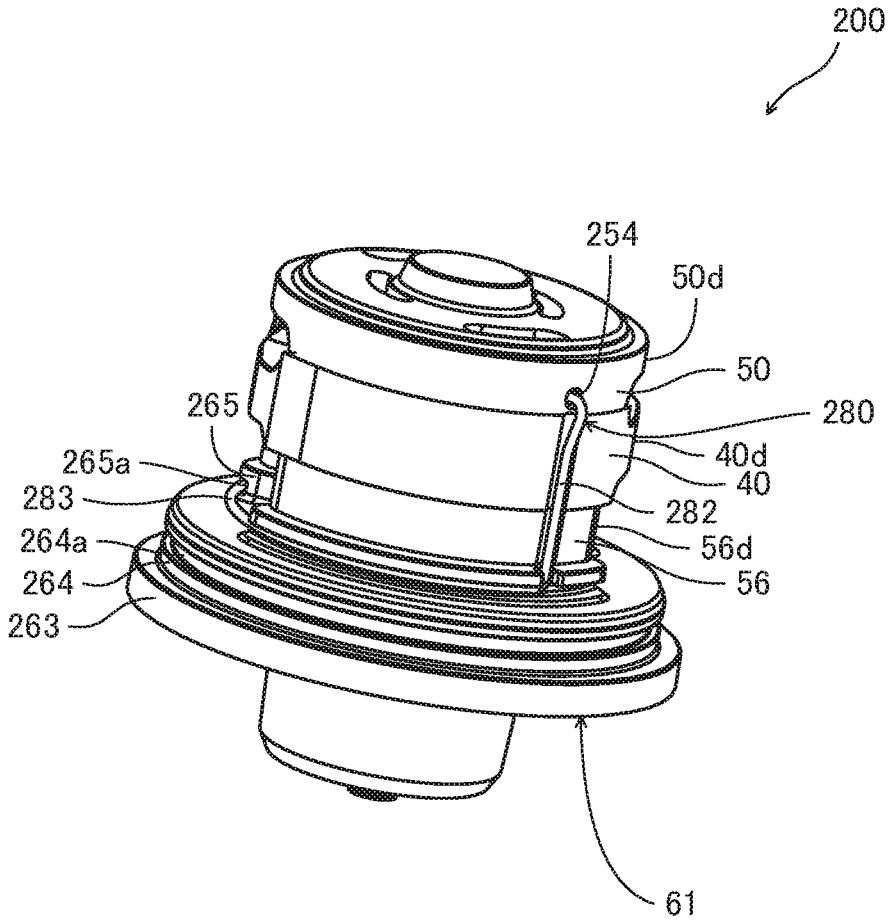
FIG. 6 is a perspective view of the cartridge vane pump according to a second embodiment of the present invention.

As shown in FIG. 6, the vane pump 200 includes a linkage wire (linkage member) 280 that links the body-side side plate 50 and the cover 61. In other words, in the vane pump 200, the body-side side plate 50 is linked to the cover 61 by the linkage wire 280 instead of the flat spring 80 of the vane pump 100 (see FIG. 4, etc.).

Figure 7:
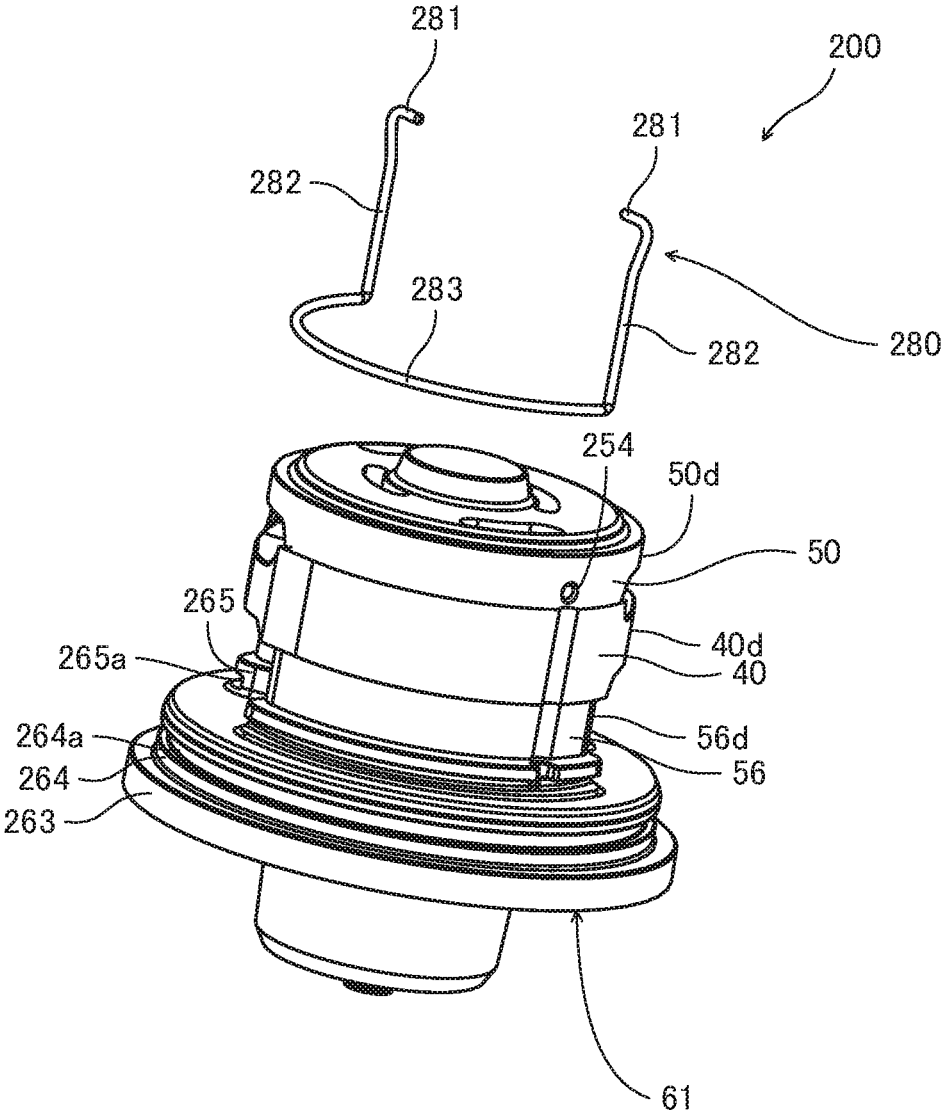
FIG. 7 is a perspective view of the cartridge vane pump shown in FIG. 6, and shows a state in which a linkage wire is removed from a body-side side plate.
Figure 8:
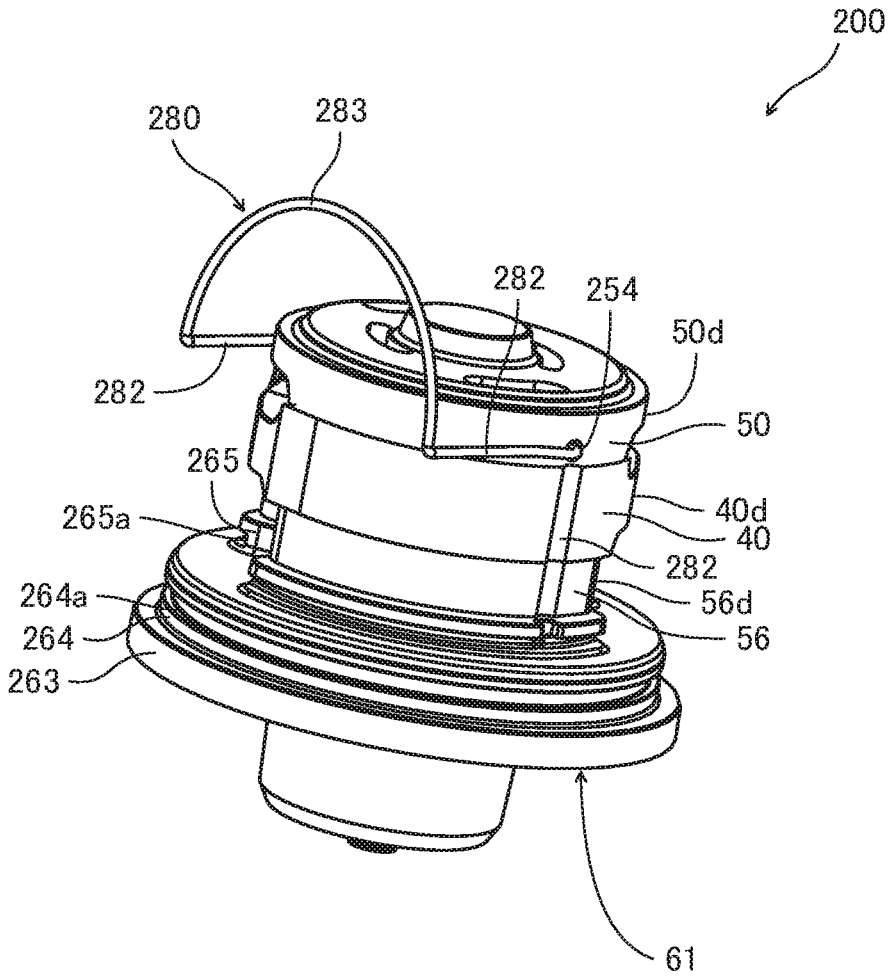
FIG. 8 is a perspective view of the cartridge vane pump shown in FIG. 6, and shows a state in which the linkage wire is attached to the body-side side plate.

As shown in FIGS. 6 and 7, the linkage wire 280 has a pair of linkage portions 281 linked to the body-side side plate 50, a pair of extended portions 282 extending along the axial direction, and a support portion 283 configured to support the cover 61. The pair of linkage portions 281 are respectively inserted, in a freely rotatable manner, into a pair of holes 254 that open at the outer circumferential surface 50*d* of the body-side side plate 50. In FIGS. 6-9, only one of the pair of holes 254 is illustrated.

The pair of extended portions 282 face the outer circumferential surface 40*d* of the cam ring 40 and the outer circumferential surface 56*d* of the cover-side side plate 56. The pair of linkage portions 281 project radially inward from the pair of extended portions 282. In other words, the pair of extended portions 282 extend from the pair of linkage portions 281 in the axial direction towards the cover 61.

The support portion 283 of the linkage wire 280 is formed between the pair of extended portions 282, and connects the pair of extended portions 282 to each other. The support portion 283 is formed so as to be deformed when the external force is applied to the pair of linkage portions 281 and so as to return to the original shape when the external force is released.

As the support portion 283 is deformed, a distance between the pair of extended portions 282 and a distance between the pair of linkage portions 281 are changed. By changing the distance between the pair of linkage portions 281, it becomes possible to insert the pair of linkage portions 281 into the pair of holes 254 of the body-side side plate 50 and to move the pair of linkage portions 281 out from the pair of holes 254 of the body-side side plate 50.

The cover 61 of the vane pump 200 has a main body portion 263 that is brought into contact with the upper surface 70*a* of the body 70 (see FIG. 1), a fitting portion 264 that is fitted to the inner circumferential surface of the first concave portion 71*a* of the body 70, and a small-diameter portion 265 having an outer diameter that is smaller than the outer diameter of the fitting portion 264. The fitting portion 264 projects out from the main body portion 263 in the axial direction. An outer circumferential surface of the fitting portion 264 is formed with an annular groove 264*a* for accommodating an O-ring (not shown).

The small-diameter portion 265 projects out from the fitting portion 264 in the axial direction towards the opposite side from the main body portion 263. An end surface of the small-diameter portion 265 is brought into contact with the cover-side side plate 56. A groove (recessed portion) 265*a* is formed in an outer circumferential surface of the small-diameter portion 265 so as to extend in the circumferential direction. The support portion 283 of the linkage wire 280 is inserted into the groove 265*a*.

The support portion 283 is formed to have an arc shape so as to correspond to the groove 265*a* of the cover 61 and is inserted into the groove 265*a* as the pair of linkage portions 281 are rotated. A side surface of the groove 265*a* faces the support portion 283 in the axial direction. With such a configuration, the cover 61 is supported by the support portion 283.

Similarly to the flat spring 80 of the vane pump 100 (see FIG. 4, etc.), the linkage wire 280 is accommodated in the low pressure chamber 72 (see FIG. 1). Thus, a space for accommodating the linkage wire 280 need not be formed separately from the low pressure chamber 72 in the body 70. Therefore, it is possible to reduce the size of the body 70, and hence, it is possible to reduce the size of the pump device provided with the vane pump 200.

Next, a description will be given to a method of assembling the vane pump 200. A procedure to stack the cover-side side plate 56, the cam ring 40, and the body-side side plate 50 on the cover 61 is substantially the same as the method of assembling the vane pump 100, and therefore, the description thereof will be omitted in this section.

After the cover-side side plate 56, the cam ring 40, and the body-side side plate 50 are stacked on the cover 61, the pair of linkage portions 281 of the linkage wire 280 are inserted into the pair of holes 254 of the body-side side plate 50.

More specifically, the external force is first applied to the pair of linkage portions 281 of the linkage wire 280 to deform the support portion 283 such that the distance between the pair of linkage portions 281 becomes longer than the outer diameter of the body-side side plate 50. Thereafter, the pair of linkage portions 281 are moved to the vicinity of the pair of holes 254. By releasing the external force from the pair of linkage portions 281 and by allowing the support portion 283 to return to the original shape, the pair of linkage portions 281 are respectively inserted into the pair of holes 254 and linked to the body-side side plate 50 (see FIG. 8).

The pair of linkage portions 281 may be inserted into the pair of holes 254 of the body-side side plate 50 before the body-side side plate 50 is stacked on the cam ring 40.

Figure 9:
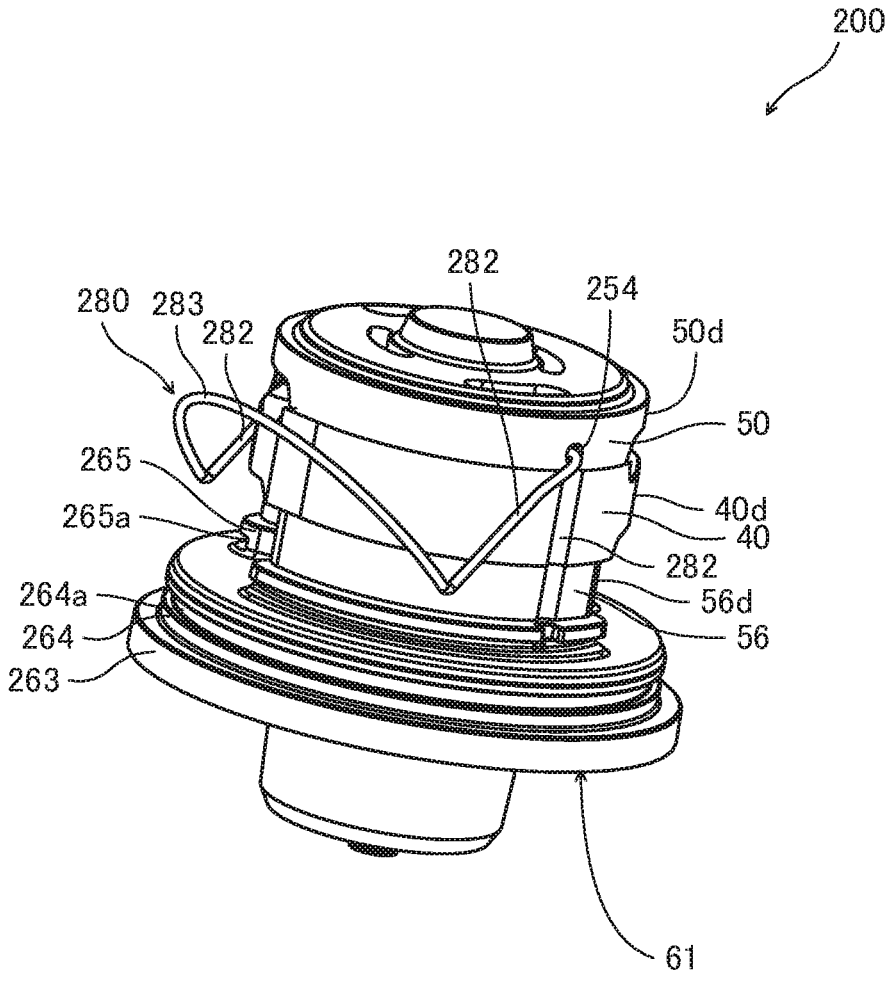
FIG. 9 is a perspective view of the cartridge vane pump shown in FIG. 6, and shows a state in which the linkage wire is rotated.

Next, the pair of linkage portions 281 are rotated such that the support portion 283 approaches the groove 265*a* of the cover 61 (see FIG. 9). The support portion 283 is inserted into the groove 265*a* of the cover 61, and thereby, the cover 61 is supported by the support portion 283. As a result, the linkage between the cover 61 and the body-side side plate 50 is achieved, and the assembly of the vane pump 200 is completed.

According to the above-mentioned second embodiment, in addition to the advantages offered by the first embodiment, the advantages described below are afforded.

In the vane pump 200, only by rotating the pair of linkage portions 281, it is possible to switch a state in which the cover 61 is supported by the support portion 283 and a state in which the supported state is released. Therefore, a state in which the body-side side plate 50 is linked to the cover 61 by the linkage wire 280 and a state in which the linkage is released can be switched with ease, and so, assembly and disassembly of the vane pump 200 becomes easier.

Similarly to the flat spring 80 of the vane pump 100 (see FIG. 4, etc.), the linkage wire 280 may be formed such that the body-side side plate 50, the cam ring 40, and the cover-side side plate 56 are biased towards the cover 61.

Third Embodiment

Next, a vane pump 300 according to a third embodiment of the present invention will be described with reference to FIGS. 10 and 11. Configurations that are the same as those in the vane pump 100 are assigned the same reference numerals and description thereof shall be omitted. In addition, a sectional view of the pump device provided with the vane pump 300 is substantially the same as the sectional view of the vane pump 100 (see FIG. 1), and so, illustration thereof is omitted in this section.

Figure 10:
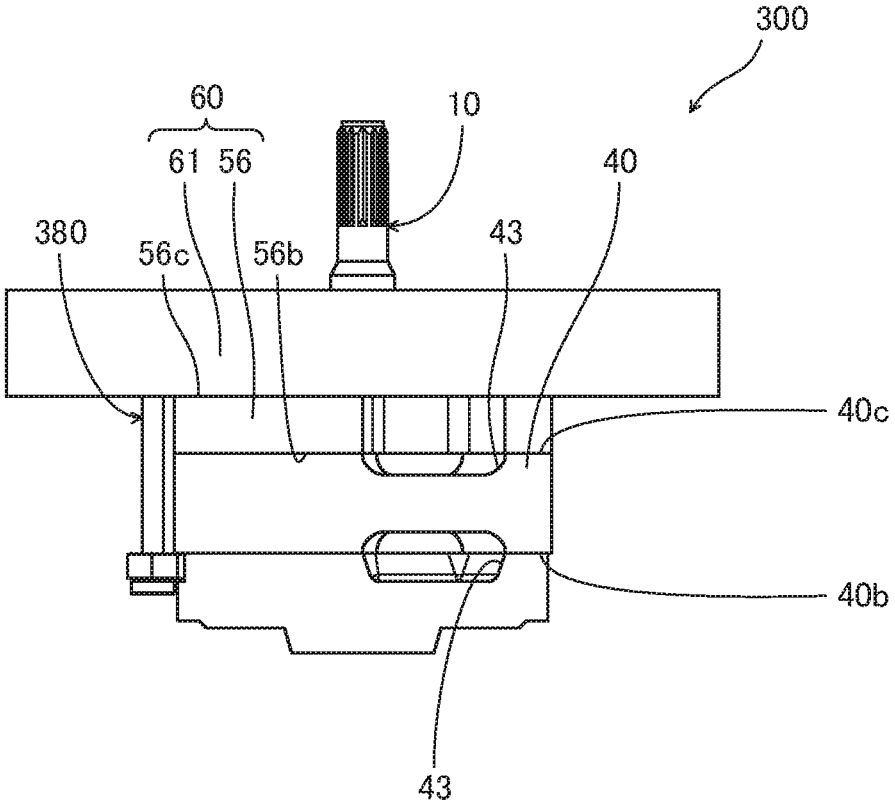
FIG. 10 is a front view of the cartridge vane pump according to a third embodiment of the present invention.

As shown in FIG. 10, the vane pump 300 includes a linkage pin (linkage member) 380 that links the body-side side plate 50 and the cover 61. In other words, in the vane pump 300, the body-side side plate 50 is linked to the cover 61 by the linkage pin 380 instead of the flat spring 80 of the vane pump 100 (see FIG. 4, etc.).

The movement of the body-side side plate 50 in the direction away from the cover 61 is restricted by the linkage pin 380. Thus, even if only the cover 61 is lifted up in a state in which the lower surface 61*b* of the cover 61 is facing downwards, the cover-side side plate 56, the rotor 20, the vanes 30, the cam ring 40, and the body-side side plate 50 are not separated away from the cover 61. Therefore, it is possible to transport the vane pump 100 while preventing disengagement thereof due to vibrations, etc. during the transport, and so, it is possible to attach the vane pump 100 to the body 70 (see FIG. 1). Thus, it is possible to improve the ease of attachment of the vane pump 100.

In addition, in detaching the vane pump 300 from the body 70, the rotor 20, the vanes 30, the cam ring 40, the body-side side plate 50, and the cover-side side plate 56 are moved out from the accommodating concave portion 71 (see FIG. 1) only by separating the cover 61 from the body 70 (see FIG. 1). Therefore, it is possible to detach the vane pump 300 from the body 70 with ease.

The linkage pin 380 is provided to extend between the cover 61 and the body-side side plate 50 over the outer circumferential surface 40*d* of the cam ring 40 and the outer circumferential surface 56*d* of the cover-side side plate 56. Thus, there is no need to form a hole for inserting the linkage pin 380 in the cam ring 40 and the cover-side side plate 56. Therefore, because it is not necessary to process the cam ring 40 and the cover-side side plate 56 for linking the cover 61 and the body-side side plate 50, it is possible to form the vane pump 300 with ease.

Similarly to the flat spring 80 of the vane pump 100 (see FIG. 4, etc.), the linkage pin 380 is accommodated in the low pressure chamber 72 (see FIG. 1). Thus, a space for accommodating the linkage pin 380 need not be formed separately from the low pressure chamber 72 in the body 70. Therefore, it is possible to reduce the size of the body 70, and hence, it is possible to reduce the size of the pump device provided with the vane pump 300.

Figure 11:
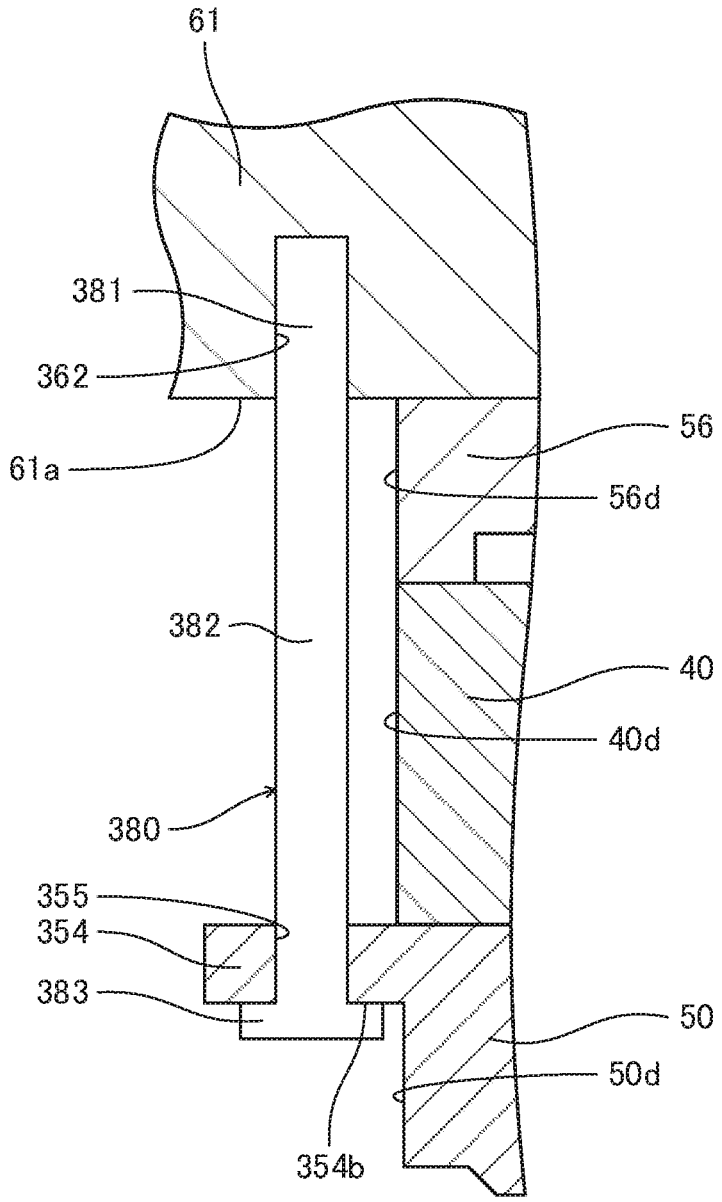
FIG. 11 is an enlarged sectional view of the cartridge vane pump shown in FIG. 10, and shows a vicinity of a linkage pin.

As shown in FIG. 11, the linkage pin 380 has an extended portion 382 extending along the axial direction and a support portion 383 configured to support the body-side side plate 50. The extended portion 382 is formed to have a rod shape, and a one end portion 381 of the extended portion 382 is press-fitted into a hole 362 that opens at the lower surface 61*b* of the cover 61. In other words, the one end portion 381 of the extended portion 382 functions as a linkage portion that is linked to the cover 61.

The support portion 383 of the linkage pin 380 is provided on an other end portion of the extended portion 382 and formed in a disc shape. The outer diameter of the support portion 383 is larger than the outer diameter of the extended portion 382, and the support portion 383 projects out from the extended portion 382 in the direction intersecting the extended portion 382.

The body-side side plate 50 is formed with a projected part 354 that projects radially outward from the outer circumferential surface 50*d*. The projected part 354 is formed with a hole 355 penetrating in the axial direction. The extended portion 382 of the linkage pin 380 is inserted into the hole 355 of the projected part 354.

In a state in which the extended portion 382 is inserted in the hole 355 of the projected part 354, a lower surface 354*b* of the projected part 354 faces the support portion 383 in the axial direction. With such a configuration, the body-side side plate 50 is supported by the support portion 383.

Next, a description will be given to a method of assembling the vane pump 300. A procedure to stack the cover-side side plate 56, the cam ring 40, and the body-side side plate 50 on the cover 61 is substantially the same as the method of assembling the vane pump 100, and therefore, the description thereof will be omitted in this section.

After the cover-side side plate 56, the cam ring 40, and the body-side side plate 50 are stacked on the cover 61, the extended portion 382 of the linkage pin 380 is inserted into the hole 355 of the projected part 354 of the body-side side plate 50.

Next, the one end portion 381 of the extended portion 382 is press-fitted into the hole 362 of the cover 61. As a result, the one end portion 381 of the extended portion 382 is linked to the cover 61. As a result, the projected part 354 is supported by the support portion 383, and the cover 61 is linked to the body-side side plate 50.

By performing the above-described procedure, the assembly of the vane pump 300 is completed.

According to the above-mentioned third embodiment, in addition to the advantages offered by the first embodiment, the advantages described below are afforded.

In the vane pump 300, because the one end portion 381 of the linkage pin 380 is press-fitted into the hole 362 of the cover 61, the one end portion 381 of the linkage pin 380 is not moved out easily from the hole 362 of the cover 61. Therefore, it is possible to prevent the linkage pin 380 from being dismounted from the cover 61, and so, it is possible to prevent unintentional disassembly of the vane pump 300.

The configurations, operations, and effects of the embodiment according to the present invention will be collectively described below.

This embodiment relates to the cartridge vane pumps 100, 200, 300 that is attached to the body 70 of the fluid pressure device. The cartridge vane pump 100, 200 or 300 includes the rotor 20 configured to be driven rotationally; the plurality of vanes 30 provided in the rotor 20, the plurality of vanes 30 being configured to reciprocate in the radial direction of the rotor 20; the cam ring 40 having the inner circumference cam face 40*a* with which the plurality of vanes 30 are brought into sliding contact; the body-side side plate 50 brought into contact with the rotor 20 and the first end surface 40*b* of the cam ring 40; the cover member 60 brought into contact with the rotor 20 and the second end surface 40*c* of the cam ring 40, the cover member 60 being attached to the body 70; and the flat spring 80, the linkage wire 280, or the linkage pin 380 provided to extend between the body-side side plate 50 and the cover member 60 over the outer circumferential surface 40*d* of the cam ring 40, the flat spring 80, the linkage wire 280, or the linkage pin 380 being configured to link the body-side side plate 50 and the cover member 60.

With this configuration, because the body-side side plate 50 and the cover member 60 are linked by the flat spring 80, the linkage wire 280, or the linkage pin 380, the rotor 20, the vanes 30, and the cam ring 40 are held between the cover member 60 and the body-side side plate 50. Therefore, it is possible to transport the cartridge vane pump 100, 200 or 300 while preventing disengagement thereof due to vibrations, etc. during the transport, and in addition, it is possible to attach the cartridge vane pump 100, 200 or 300 to the body 70. Thus, it is possible to improve the ease of attachment of the cartridge vane pump 100, 200 or 300.

In addition, in this embodiment, the flat spring 80 biases the cam ring 40 and the body-side side plate 50 towards the cover member 60.

With this configuration, because the cam ring 40 and the body-side side plate 50 are biased by the flat spring 80 towards the cover member 60, the leakage of the working oil inside the cam ring 40 from between the cam ring 40 and the body-side side plate 50 and from between the cam ring 40 and the cover member 60 tends not to be caused. Therefore, it is possible to improve the discharge performance of the cartridge vane pump 100.

In addition, in this embodiment, the flat spring 80, the linkage wire 280, or the linkage pin 380 has the linkage portion 81, 281 or 381 linked to one of the body-side side plate 50 and the cover member 60; the extended portion 82, 282 or 382 extended in the axial direction of the rotor 20 from the linkage portion 81, 281 or 381 towards other of the body-side side plate 50 and the cover member 60; and the support portion 83, 283 or 383 projected out from the extended portion 82, 282 or 382 in the direction intersecting the extended portion 82, 282 or 382, the support portion 83, 283 or 383 being configured to support the other of the body-side side plate 50 and the cover member 60.

With this configuration, the extended portion 82, 282 or 382 extends in the axial direction of the rotor 20, and the support portion 83, 283 or 383 projects out from the extended portion 82, 282 or 382 in the direction intersecting the extended portion 82, 282 or 382. In order to support the other of the body-side side plate 50 and the cover member 60 with the support portion 83, 283 or 383 in the axial direction of the rotor 20, it is only required to place the other of the body-side side plate 50 and the cover member 60 on the support portion 83, 283 or 383, and there is no need to use the special jigs. Therefore, it is possible to link the body-side side plate 50 and the cover member 60 with ease, and so, it is possible to assemble the cartridge vane pump 100, 200 or 300 with ease.

In addition, in this embodiment, the body-side side plate 50 has the groove 54 formed to open at the outer circumferential surface 50*d* of the body-side side plate 50, and the body-side side plate 50 being supported by the support portion 83 by inserting the support portion 83 into the groove 54, and the extended portion 82 is formed with the bent portion 82*a*, the bent portion 82*a* being bent between the support portion 83 and the linkage portion 81 so as to project towards the opposite side from the support portion 83 in a state in which the support portion 83 is moved out from the groove 54.

With this configuration, the bent portion 82*a* of the extended portion 82 is bent so as to project towards the opposite side from the support portion 83. Thus, only by pushing the bent portion 82*a* towards the cam ring 40 in a state in which the linkage portion 81 is linked to the body-side side plate 50, the support portion 83 slides on the outer circumferential surface 50*d* of the body-side side plate 50 and is inserted into the groove 54 of the body-side side plate 50. Therefore, it is possible to link the body-side side plate 50 and the cover member 60 with ease, and so, the assemblability of the cartridge vane pump 100 is improved. In addition, the groove 54 opens at the outer circumferential surface 50*d* of the body-side side plate 50. Thus, the support portion 83 is moved out from the groove 54 only by pulling and separating the extended portion 82 from the cam ring 40. Therefore, the linkage between the body-side side plate 50 and the cover member 60 by the flat spring 80 can be released with ease, and therefore, it is possible to easily disassemble the cartridge vane pump 100.

In addition, in this embodiment, the body-side side plate 50 has the pair of holes 254 formed to open at the outer circumferential surface 50*d*, the pair of linkage portions 281 are inserted into the holes 254 in a freely rotatable manner, the groove 265*a* is formed in an outer circumferential surface of the cover member 60, the groove 265*a* being extended in the circumferential direction, and the support portion 283 is inserted into the groove 265*a* as the pair of linkage portions 281 are rotated.

With this configuration, the support portion 283 supports the cover member 60 by being inserted into the groove 265*a* as the pair of linkage portions 281 are rotated. Thus, only by rotating the linkage portions 281, it is possible to switch a state in which the cover member 60 is supported by the support portion 283 and a state in which the supported state is released. Therefore, a state in which the body-side side plate 50 is linked to the cover member 60 by the linkage wire 280 and a state in which the linkage is released can be switched with ease, and so, the assembly and disassembly of the cartridge vane pump 200 becomes easier.

In addition, in this embodiment, the pump device 1000 includes: the cartridge vane pump 100, 200 or 300; the body 70 for accommodating the cartridge vane pump 100, 200 or 300; and the low pressure chamber 72 formed between the body 70 and an outer circumference of the cartridge vane pump 100, 200 or 300, the low pressure chamber 72 being configured to function as the suction passage 73 communicating with the suction ports 43 of the cartridge vane pump 100, 200 or 300, wherein the flat spring 80, the linkage wire 280, or the linkage pin 380 is accommodated in the low pressure chamber 72.

With this configuration, because the flat spring 80, the linkage wire 280, or the linkage pin 380 is accommodated in the low pressure chamber 72 that is formed between the body 70 and the outer circumference of the cartridge vane pump 100, 200 or 300, a separate accommodating space for providing the flat spring 80, the linkage wire 280, or the linkage pin 380 need not be formed in the body 70. Therefore, it is possible to reduce the size of the body 70, and hence, it is possible to reduce the size of the pump device 1000.

Although the embodiment of the present invention has been described above, the above embodiment is merely an illustration of one exemplary application of the present invention and is not intended to limit the technical scope of the present invention to the specific configuration of the above embodiment.

(1) In the above-mentioned embodiment, a description has been given of the balanced vane pump 100, 200 or 300. However, the present invention may also be applied to an unbalanced vane pump.

(2) In the above-mentioned embodiment, the cover member 60 is formed of the cover 61 and the cover-side side plate 56 that are formed separately. The cover 61 and the cover-side side plate 56 may be formed integrally, and the cover member 60 may be formed as a single unit part. In addition, the cover-side side plate 56 may be omitted, and the cover 61 may be brought into contact with the cam ring 40.

(3) With the above-mentioned vane pump 100, the extended portion 82 is bent even in a state in which the cover 61 is linked to the body-side side plate 50 by the flat spring 80 (a state shown in FIG. 4). In the state in which the cover 61 is linked to the body-side side plate 50 by the flat spring 80, the extended portion 82 may not be bent (the bent angle θ may be 0°).

The present application claims a priority based on Japanese Patent Application No. 2017-094163 filed with the Japan Patent Office on May 10, 2017, and all the contents of this application are incorporated herein by reference.

The invention claimed is:

1. A cartridge vane pump attached to a body of a fluid pressure device, the cartridge vane pump comprising:

a rotor configured to be driven rotationally;

a plurality of vanes provided in the rotor, the plurality of vanes being configured to reciprocate in a radial direction of the rotor;

a cam ring having an inner circumference cam face with which the plurality of vanes are brought into sliding contact;

a side member slidably contacting first sides of the rotor and the cam ring;

a cover member including a cover-side side plate and a cover, wherein the cover-side side plate slidably contacts second sides of the rotor and the cam ring, which are opposite to the first sides of the rotor and the cam ring, the cover being attached to the body; and a linkage member extending between the side member and the cover over an outer circumferential surface of the cam ring, thereby to link the side member and the cover, wherein the linkage member includes:

a linkage portion linked to one of the side member and the cover;

an extended portion extending in an axial direction of the rotor from the linkage portion towards an other of the side member and the cover; and a support portion projecting out from the extended portion in a direction intersecting the axial direction, thereby to support the other of the side member and the cover, the one of the side member and the cover has a hole which opens along an outer circumferential surface thereof, the linkage portion is inserted into the hole in a freely rotatable manner, the other of the side member and the cover has a groove extending in a circumferential direction on an outer circumferential surface thereof, and the support portion is inserted into the groove as the linkage portion is rotated.

2. The cartridge vane pump according to claim 1, wherein the linkage member configured to bias the cam ring and the side member towards the cover.

3. A pump device comprising:

the cartridge vane pump according to claim 1;

the body configured to accommodate the cartridge vane pump; and a low pressure chamber formed between the body and an outer circumference of the cartridge vane pump, the low pressure chamber being configured to function as a suction passage communicating with a suction port of the cartridge vane pump, wherein the linkage member is accommodated in the low pressure chamber.

* * * * *